US010104473B2

(12) United States Patent
Bjork et al.

(10) Patent No.: US 10,104,473 B2
(45) Date of Patent: Oct. 16, 2018

(54) AUDIO PROCESSOR WITH LINEAR AND NON-LINEAR MODELING INCLUDING LIMITER

(71) Applicant: Cirrus Logic International Semiconductor Ltd., Edinburgh (GB)

(72) Inventors: Ylva Ellen Maria Bjork, Solna (SE); Erik Vilhelm Lindahl, Stockholm (SE)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/498,800

(22) Filed: Apr. 27, 2017

(65) Prior Publication Data

US 2017/0318389 A1 Nov. 2, 2017

Related U.S. Application Data

(60) Provisional application No. 62/329,338, filed on Apr. 29, 2016.

(30) Foreign Application Priority Data

May 25, 2016 (GB) ..... 1609226.4

(51) Int. Cl.
*H04R 3/04* (2006.01)
*G10L 21/038* (2013.01)
(Continued)

(52) U.S. Cl.
CPC ..... *H04R 3/04* (2013.01); *G10L 21/038* (2013.01); *H04R 3/08* (2013.01); *H04R 29/001* (2013.01);
(Continued)

(58) Field of Classification Search
CPC ..... H04R 3/04; H04R 3/08; H04R 29/001; H04R 2430/03; H04R 2499/11; G10L 21/038
(Continued)

(56) References Cited

U.S. PATENT DOCUMENTS

2008/0175397 A1 7/2008 Holman
2011/0085678 A1 4/2011 Pfaffinger
2015/0249889 A1* 9/2015 Iyer ..... H04R 3/08 381/98

FOREIGN PATENT DOCUMENTS

WO 2015041765 A1 3/2015
WO 2015143127 A1 9/2015

OTHER PUBLICATIONS

Combined Search and Examination Report, Application No. GB1609226.4, dated Jul. 11, 2016.
(Continued)

*Primary Examiner* — Vivian Chin
*Assistant Examiner* — Douglas Suthers
(74) *Attorney, Agent, or Firm* — Jackson Walker L.L.P.

(57) ABSTRACT

Embodiments of the invention provide methods and apparatus for processing audio input signals, for example, so as to linearize the output of a given loudspeaker. An audio processor is provided, for modifying an audio signal to be provided to a loudspeaker, the audio processor comprising: a first filter stage, for applying to an audio signal a linear model describing an excursion of the loudspeaker in response to a given input signal, the linear model containing only linear terms, and for generating one or more excursion signals; a plurality of second filters for receiving the one or more excursion signals, each of the second filters configured to apply to a respective one of a plurality of frequency bands in the one or more excursion signals the inverse of a model describing an excursion of the loudspeaker in response to a given input signal; and a combiner for combining the outputs of each of the plurality of second filters. At least a first one of the plurality of second filters applies the inverse of a non-linear model describing an excursion of the loud-
(Continued)

speaker in response to a given input signal, the non-linear model comprising one or more non-linear parameters.

16 Claims, 4 Drawing Sheets

(51) Int. Cl.
*H04R 3/08* (2006.01)
*H04R 29/00* (2006.01)

(52) U.S. Cl.
CPC ..... *H04R 2430/03* (2013.01); *H04R 2499/11* (2013.01)

(58) Field of Classification Search
USPC ..... 381/98, 55, 59, 94.9
See application file for complete search history.

(56) References Cited

OTHER PUBLICATIONS

International Search Report and Written Opinion of the International Searching Authority, International Application No. PCT/GB2017/051162, dated Aug. 7, 2017.
Frank, W., "Compensation of Linear and Nonlinear Sensor Distortions by Digital Post Processing", Proceedings, International Conference for Sensors, Transducers and Systems, Jan. 1, 1995, pp. 889-892.
Soria-Rodriguez, M. et al., "Modeling and Real-Time Auralization of Electrodynamic Loudspeaker Non-Linearities", Proceedings, IEEE International Conference on Acoustics, Speech, and Signal Processing, 2004, Montreal, Quebec, Canada, May 17-21, 2004, vol. 4, May 17, 2004, pp. 81-84.

* cited by examiner

AUDIO PROCESSOR WITH LINEAR AND NON-LINEAR MODELING INCLUDING LIMITER

TECHNICAL FIELD

Examples of the present disclosure relate to methods and apparatus for processing audio signals.

BACKGROUND

Loudspeakers were invented over 150 years ago, but the loudspeakers used today are still based on the same ideas. Traditionally, good sound quality has been obtained by using expensive materials in the loudspeakers and by allowing them to be big. However, nowadays loudspeakers are wanted in applications such as mobile phones and tablets where size and weight are limited and there is a desire to decrease production costs. Special small loudspeakers, known as micro loudspeakers or microspeakers, have been developed for this purpose. However, due to restrictions in size and manufacturing costs, their sound quality can be relatively poor.

One approach to overcoming this challenge is to use digital signal processing and active control to compensate for the poor quality. That is, a digital signal processor (DSP) may be used to adapt the input audio signal such that, once passed through the loudspeaker, a desired output is achieved. However, such techniques require the application of an accurate model in order to be effective.

SUMMARY

One particular aspect that has made such processing of the audio signal difficult is the non-linear response of most systems. That is, an ideal, linear system will change the gain and the phase of the frequencies, without introducing additional frequency content. However, a non-linear system will introduce frequency content that was not present in the input signal (e.g., harmonics or intermodulation). Such non-linearities can be challenging to model and compensate for.

One aspect of the invention provides an audio processor, for modifying an audio signal to be provided to a loudspeaker, the audio processor comprising: a first filter stage, for applying to an audio signal a linear model describing an excursion of the loudspeaker in response to a given input signal, the linear model containing only linear terms, and for generating one or more excursion signals; a plurality of second filters for receiving the one or more excursion signals, each of the second filters configured to apply to a respective one of a plurality of frequency bands in the one or more excursion signals the inverse of a model describing an excursion of the loudspeaker in response to a given input signal; and a combiner for combining the outputs of each of the plurality of second filters. At least a first one of the plurality of second filters applies the inverse of a non-linear model describing an excursion of the loudspeaker in response to a given input signal, the non-linear model comprising one or more non-linear parameters.

BRIEF DESCRIPTION OF THE DRAWINGS

For a better understanding of examples of the present disclosure, and to show more clearly how the examples may be carried into effect, reference will now be made, by way of example only, to the following drawings in which.

DETAILED DESCRIPTION

Figure 1:
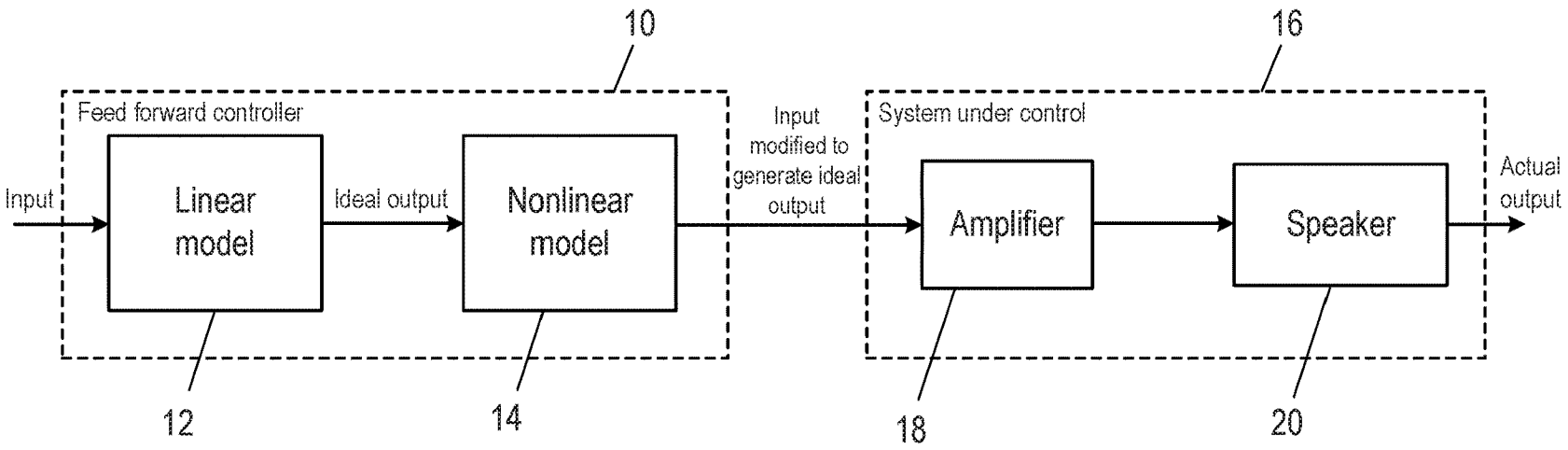
FIG. 1 is a schematic illustration of an audio processor and a loudspeaker system.

FIG. 1 is a schematic illustration of an audio processor 10 and a loudspeaker system 16. The audio processor 10 may be provided on an integrated circuit, or "chip", and may be, or may form part of, an audio codec.

The audio processor 10 is based on feed-forward control to modify an input audio signal and so produce a desired output of the loudspeaker system 16. An audio input signal is thus provided to the processor 10, and particularly to a module 12 that implements a linear model of the loudspeaker system 16. The linear model thus represents an "ideal" loudspeaker system, and this will be explored in greater detail below. The output of the module 12 is an "ideal" excursion signal representing a desired output signal from the loudspeaker system 16 (assuming the loudspeaker is itself ideal, i.e. linear). Note that the linear model implemented in the module 12 may itself be altered so as to add EQ to the audio signal, or so as to achieve a desired response, e.g. a flat response.

In one embodiment, the linear model may contain linear parameters for one or more Thiele-Small (TS) parameters. For example, the model may contain linear parameters for one or more (or all) of the following:

- $K_{ms}$—the mechanical stiffness of the driver suspension of the loudspeaker.
- $R_{ms}$—the mechanical resistance of the driver suspension.
- BI—the product of magnet field strength in the voice coil gap and the length of wire in the magnetic field (also known as the force factor).
- $L_e$—the voice coil inductance.
- $M_{ms}$—the mass of the diaphragm and coil, including acoustic load.

However, real loudspeaker systems are not ideal, and on its own a linear model may not describe a real loudspeaker system sufficiently accurately. Thus the processor 10 comprises a second module 14 that implements a non-linear model of the loudspeaker system 16. The non-linear model may comprise the linear model implemented in the first module 12, with additional non-linear components.

Thus the non-linear model implemented in the second module 14 may contain linear and non-linear parameters for one or more (or all) of the following:

- $K_{ms}$—the mechanical stiffness of the driver suspension of the loudspeaker.
- $R_{ms}$—the mechanical resistance of the driver suspension.
- BI—the product of magnet field strength in the voice coil gap and the length of wire in the magnetic field (also known as the force factor).
- $L_e$—the voice coil inductance.
- $M_{ms}$—the mass of the diaphragm and coil, including acoustic load.

In particular embodiments, the non-linear model may contain non-linear parameters for the force factor, BI, and/or the suspension mechanical stiffness $K_{ms}$. The latter term is the reciprocal of the suspension mechanical compliance ($C_{ms}$).

The second module 14 may output a signal that will achieve the ideal excursion signal output from the first module 12 when inputted to the real system 16. The second module 14 may apply an inverse of the non-linear model such that a more accurate replica of the original audio input signal is output from the system 16.

The output of the second module 14 (and of the audio processor 10) is an audio signal that is modified to take into account both the linear and the non-linear aspects of the loudspeaker system 16. This modified signal is provided to an amplifier 18 of the system 16, and the amplified signal is provided from the amplifier 18 to the loudspeaker 20. In an alternative embodiment, the amplifier 18 may also be part of the integrated circuit, "chip" or audio codec in which the processor 10 is embodied. Note that, as the amplifier 18 is located downstream of the modules 12, 14 in the signal path, the effects of the amplifier 18 are also taken into consideration in the linear and non-linear models applied in the modules 12, 14. In alternative configurations, the amplifier 18 may not have to be taken into account in those models and modules (e.g. it could be modelled separately).

The loudspeaker 20 may be conventional, and in one embodiment is a micro loudspeaker (or microspeaker). The loudspeaker 20 comprises a magnetic circuit that generates a magnetic field. A voice coil is placed in this field and when a current passes through it, a magnetic force is created which makes the voice coil move. A diaphragm is attached to the voice coil, and therefore this also moves and its displacement is denoted x. The diaphragm is attached to a frame by a suspension that acts to limit the displacement and bring the coil back to its original position when the force is reduced.

The parameters of the linear and non-linear models may be determined using any of various techniques known in the art. For example, Richard Small ("Direct-radiator loudspeaker system analysis", Journal of the Audio Engineering Society, volume 20, pp 383-395 (1972)) first developed a linear model for loudspeakers, and further methods for determining those linear parameters have been described in a paper by Svante Granqvist (available at http://www.csc.kth.se/utbildning/kth/kurser/DT2420/Lab2_TS-parametrar.pdf). Methods for determining the non-linear parameters are disclosed in a thesis by Bright ("Active Control of Loudspeakers: An Investigation of practical applications", PhD Thesis, Technical University of Denmark (2002)), a paper by Klippel ("Nonlinear Adaptive Controller for Loudspeakers with Current Sensor" (1999), available at http://www.klippel.de/fileadmin/klippel/Bilder/Know-How/Literature/Papers/Nonlinear_Adaptive_Controller_with_Current_Sensor_99.pdf), and Gao and Snelgrove ("Adaptive linearization of a loudspeaker", Proceedings—ICASSP, IEEE International Conference on Acoustics, Speech and Signal Processing, Volume 5, pp 3589-3592, (1991)). These methods are given as examples only. There are many alternative methods of determining linear and non-linear parameters for models of loudspeakers and the present disclosure is not limited to any particular method or methods.

A speaker is a time variant system, changing with factors such as temperature and ageing, so in order to keep the speaker from drifting away from the model, these changes may be tracked and passed to the feed forward controller.

Figure 2:
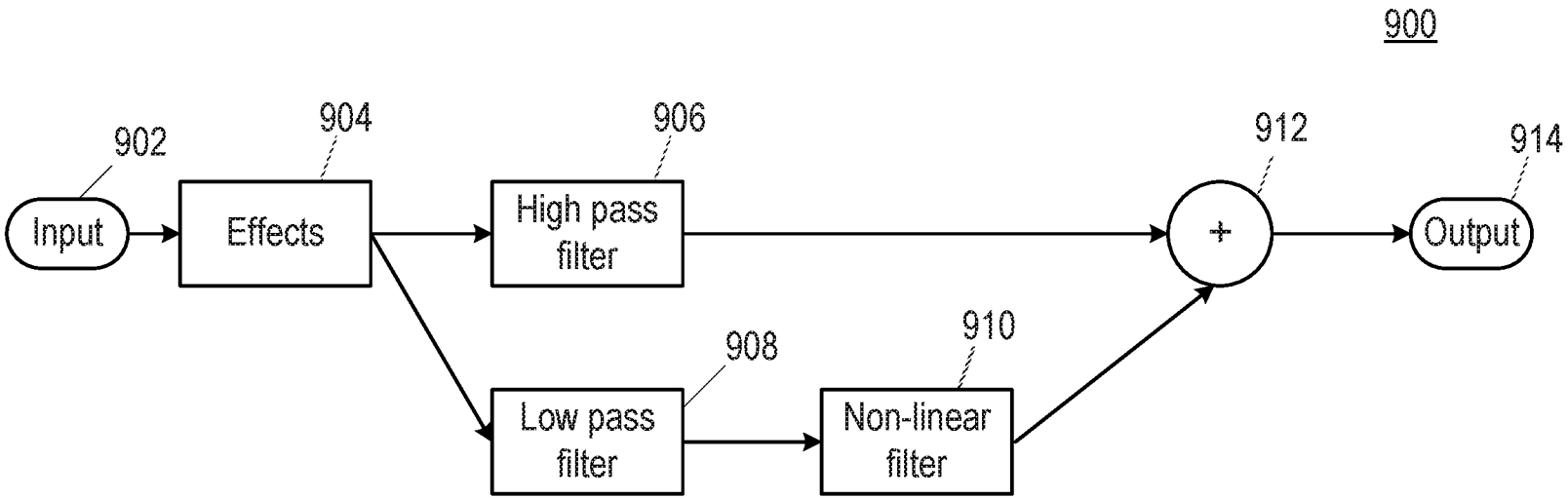
FIG. 2 is a schematic illustration of an audio processor.

FIG. 2 shows an audio processor 900 according to further embodiments of the invention. The audio processor 900 may be employed as the processor 10 shown in FIG. 1, for example.

The processor 900 comprises an input 902 which receives an input signal to be filtered. The input signal may be an audio signal, which is to be modified so as to linearize the output of a loudspeaker to which the processor 900 is coupled.

The input signal is provided to an optional effects block 904 that is configured to alter the input signal so as to alter the speaker output in some desired way. For example, the block 904 may apply one or more of: parametric EQ, compressors, limiters, virtual base or virtual surround, stereo effects, etc. Speaker protection may also be applied by the block 904.

The output of the effects block 904 is split, with the signal on one branch being passed to a high-pass filter 906, and the signal on another branch being passed to a low-pass filter 908. Each of the filters may have a common cut-off frequency, i.e. with the high-pass filter 906 filtering out components of the signal below a certain frequency and the low-pass filter 908 filtering out components of the signal above a certain frequency.

The output of the low-pass filter 908 is then passed to a non-linear filter 910. The non-linear filter may implement a model of the loudspeaker system 16 that comprises non-linear terms. The non-linear terms may describe BI(x), i.e. the force-factor of the loudspeaker 20. The model may further comprise linear terms.

In one embodiment, the non-linear filter 910 applies an inverse of the model of the loudspeaker system 16, such that the audio input signal received at the input 902 is modified so as to achieve a desired output once passed through the loudspeaker system 16. Note that a linear model may be applied to the audio input signal, e.g. prior to the effects block 904, substantially as shown in FIG. 1 (e.g. the action of the first module 12).

The outputs of the non-linear filter 910 and the high-pass filter 906 are combined in a combining element 912, and then provided to an output 914 for, e.g., provision to a loudspeaker system. Note that the high-frequency arm may comprise one or more delay elements to account for the delay introduced in the non-linear filter 910 (i.e. ensuring that components of the audio input signal are combined synchronously).

The processor 900 shown in FIG. 2 thus applies a non-linear model only to low-frequency components of the input signal. This embodiment therefore takes into account the possibility that the non-linear model may only model the non-linear parameters of the loudspeaker system sufficiently well over a limited range of frequencies, i.e. in the illustrated embodiment, at relatively low frequencies. If the non-linear model is not sufficiently accurate at other frequencies, it may be better simply not to apply the model to those frequencies.

The processor 900 shown in FIG. 2 may be extended or adapted so as to apply the non-linear model, or different non-linear models, to different frequency bands in the input signal. For example, the processor 900 may comprise more than two branches with corresponding filters (e.g. high-pass, low-pass and band-pass filters) designed to split the input signal into more than two frequency bands. A non-linear filter may be applied to one or more of the branches. If more than one non-linear filter is supplied in more than one corresponding branch, those non-linear filters may have the same or different parameters (such that the non-linear filter can be adapted specifically for each frequency band). One or more of the branches may not have any non-linear filters.

Figure 3:
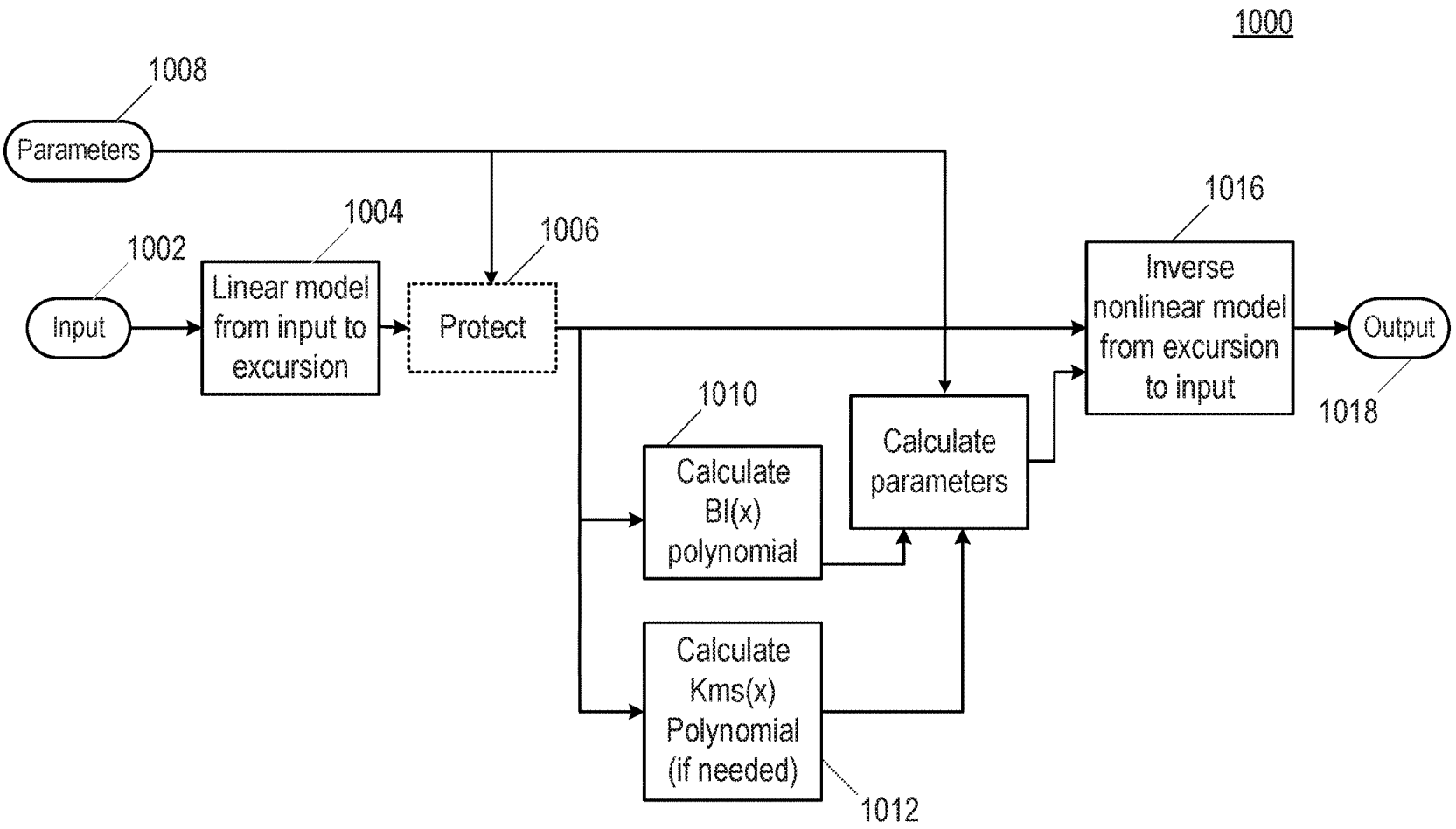
FIG. 3 is a schematic illustration of another audio processor.

FIG. 3 shows an example of a further audio processor 1000 according to embodiments of the invention. The audio processor 1000 may be employed as the audio processor 10 shown in FIG. 1.

The audio processor 1000 comprises an input 1002 which receives an input signal to be processed. The input signal may be an audio input signal, for example.

A linear filter 1004 receives the input signal and applies a linear model of the loudspeaker system to which the audio signal is to be provided. The input signal is thus converted from an audio signal into a signal indicating the excursion of the loudspeaker (if that loudspeaker was ideal, i.e. linear).

Optionally, the audio processor 1000 comprises a protect block 1006 that receives the output of the linear filter 1004 and modifies that signal so as to prevent over-excursion of the loudspeaker. That is, the output of the linear filter 1004 is a representation of the expected excursion of the loudspeaker. The loudspeaker will have an excursion limit above which the speaker should not be driven (else it would be damaged). The protect block 1006 may receive the expected excursion of the speaker, output from the linear filter 1004, and adapt the signal so as to prevent the loudspeaker being driven over its excursion limit. In practice, the loudspeaker may be driven to its limit or slightly over without significant damage being caused. The protect block 1006 may therefore ensure that the loudspeaker is not driven significantly over its excursion limit. The excursion limit may be provided by an input 1008 for receiving one or more parameters from other components of the system in which the processor 1000 is implemented. In an alternative embodiment, protection against over-excursion may be applied before the linear filter 1004 (or even in the input signal).

The output of the protect block 1006 is split into two or more branches. In the illustrated embodiment, the output is split into three branches.

One signal is passed to a block 1010 that is configured to calculate the (non-linear) force factor of the loudspeaker.

Another signal is passed to a block 1012 that is configured to calculate a different non-linear term of the non-linear model. For example, in the illustrated embodiment the block 1012 is configured to calculate $k_{ms}(x)$. In further embodiments, the block 1012 may calculated different terms (if provided for in the non-linear model), or additional branches may be supplied with separate blocks for calculating additional non-linear terms.

The outputs of the blocks 1010 and 1012 are provided to a further block 1014 that calculates filter coefficients based on the BI(x) and/or $k_{ms}(x)$ values, and these are output to a non-linear filter 1016. The output of the protect block 1006 (i.e. one of the branches not provided with a parameter-calculating block) is also provided to the non-linear filter 1016, and this signal is filtered by the non-linear filter 1016 implementing at least the coefficients calculated in block 1014. In one embodiment, the filter 1016 implements an inverse of the loudspeaker model, additionally including the linear parameters. The filter 1016 thus converts the signal back from a signal representing an excursion to an audio signal. However, the signal is modified so as to substantially remove or reduce non-linear components of the loudspeaker response. The output of the filter 1016 is then provided to an output 1018 to be coupled to the loudspeaker.

Figure 4:
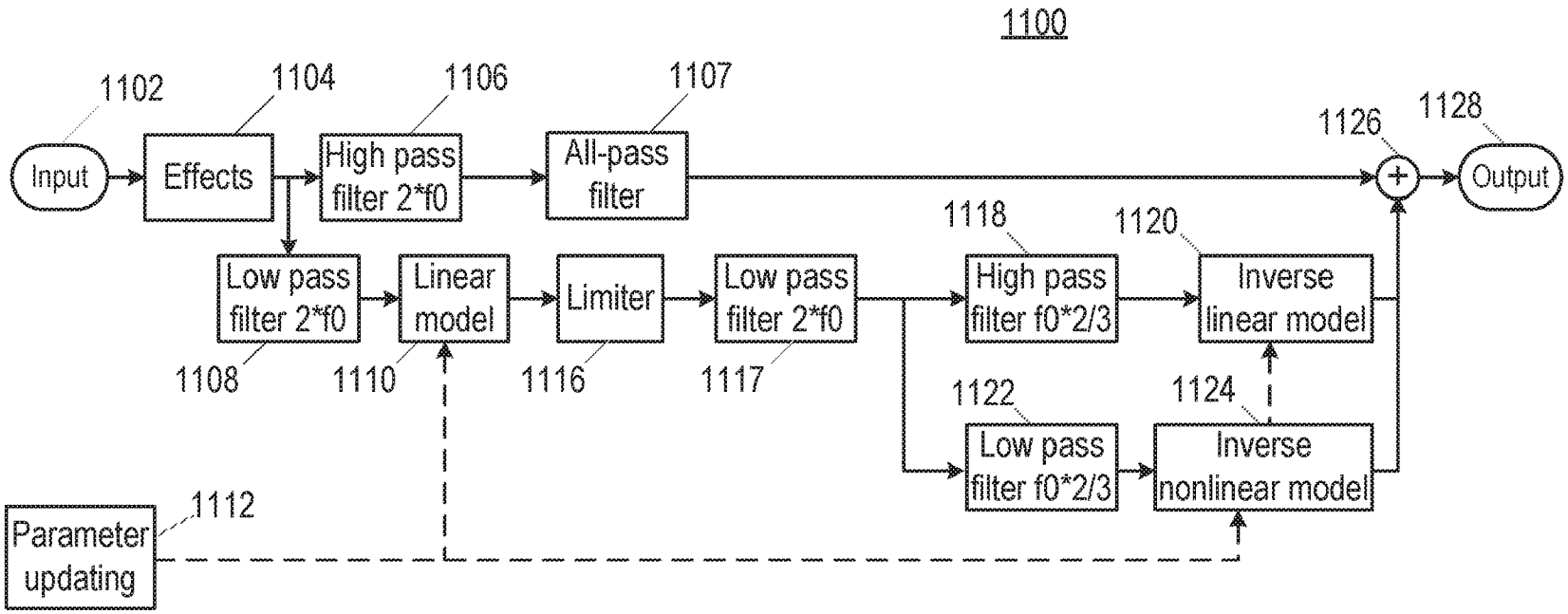
FIG. 4 is a schematic illustration of a further audio processor.

FIG. 4 shows an example of a further audio processor 1100 according to embodiments of the invention. The audio processor 1100 may be employed as the audio processor 10 shown in FIG. 1, for example.

The audio processor 1100 comprises an input 1102 which receives an input signal to be processed. The input signal may be an audio input signal, for example.

The input signal is provided to an optional effects block 1104 that is configured to alter the input signal so as to alter the speaker output in some desired way. For example, the block 1104 may apply one or more of: parametric EQ, compressors, limiters, virtual base or virtual surround, stereo effects, etc.

The output of the effects block 1104 is split into two or more branches. A high-pass filter 1106 in the first branch filters out components of the signal below a certain frequency. A low-pass filter 1108 in the second branch filters out components of the signal above a certain frequency. The cut-off frequency in both cases may be set relatively high (i.e. high enough such that the excursion is below a threshold and does not have to be taken into account), e.g. above the resonant frequency ($f_0$) of the loudspeaker 20. For example, the cut-off frequency may be set at $2*f_0$. The high-frequency components of the signal may be provided directly to a combining element 1126 without further processing (except for one or more delay elements and/or all-pass filters configured to achieve synchronicity between the various split signals). High-frequency components of audio signals typically do not have a significant impact on the excursion of the loudspeaker, and therefore removing those components from the processing in this way may act to advantageously lessen the processing intensity required in other branches.

The output of the low-pass filter 1108 is provided to a linear filter 1110 that implements a linear model of the loudspeaker 20. The parameters of the linear model (and thus the coefficients of the filter 1110) may be updated via a parameter updating module 1112 to take account of the ageing of the loudspeaker and/or changing temperature, for example. The parameter updating module 1112 receives suitable parameter inputs from one or more other components of the system, not illustrated, in which the processor 1100 is implemented (e.g. a temperature sensor, an applications processor, etc) and provides those parameters to at least the filter 1110.

The output of the filter 1110 is thus a representation of the excursion of the loudspeaker 20 as a result of the audio input signal, if that loudspeaker was ideal (i.e. had only linear terms). The output signal is provided to a limiter block 1116 that modifies the signal so as to prevent over-excursion of the loudspeaker 20. That is, the loudspeaker will have an excursion limit above which the speaker should not be driven (else it would be damaged). The limiter block 1116 may receive the expected excursion of the speaker, output from the linear filter 1110, and adapt the signal so as to prevent the loudspeaker being driven over its excursion limit. In practice, the loudspeaker may be driven to its limit or slightly over without significant damage being caused. The limiter block 1116 may therefore ensure that the loudspeaker is not driven significantly over its excursion limit.

The output of the limiter block 1116 is passed to a low-pass filter 1117 that removes and high-frequency noise introduced by the limiter block. The low-pass filter 1117 may therefore apply a cut-off frequency that is substantially the same as low-pass filter 1108, e.g. $2*f_0$.

The output of the low-pass filter 1117 is split into multiple branches, with each branch comprising one or more of an all-pass filter, a high-pass filter, a low-pass filter and a band-pass filter, such that the signal in each branch represents a different frequency band. In the illustrated embodiment, the output of the low-pass filter 1117 is split into two branches. One branch comprises a high-pass filter 1118, while the other branch comprises a low-pass filter 1122. Each of the filters 1118, 1122 has a common cut-off frequency such that the entire signal is represented by combining the signals on both branches. The cut-off frequencies may be chosen so as to define a frequency band or bands over which a non-linear model works well, and one or more frequency bands over which the non-linear model works less well or a different non-linear model works better. In the illustrated example, the cut-off frequency is chosen as $\frac{2}{3}*f_0$. At frequencies above this cut-off frequency, the non-linear model works relatively poorly; at frequencies below this cut-off frequency, the non-linear model works relatively well.

Therefore a non-linear filter 1124 is provided in the low-frequency branch, implementing the inverse of a non-linear model describing the excursion of the loudspeaker in response to a given input signal. The non-linear model, as described above, may comprise both linear terms and non-linear terms. A non-linear filter 1120 is provided in the high-frequency branch, implementing the inverse of a linear model describing the excursion of the loudspeaker in response to a given input signal. The linear model may comprise the linear terms of the non-linear model.

As with the linear filter 1110, the parameters implemented in the filters 1120 and 1124 may be updated with parameters received from the parameter updating module 1112. The non-linear parameters for the non-linear filter 1124 may be calculated on a sample-by-sample basis as described above using blocks 1010 and 1012 (with respect to FIG. 3).

The respective outputs of these filters 1120, 1124 are combined with the output of the high-pass filter 1106 in the combining element 1126, and provided to an output 1128 of the processor 1100 for further provision to the loudspeaker. The output of the high-pass filter 1106 is provided to the combining element 1126 via an all-pass filter 1107, to ensure that changes in phase are compensated for.

Embodiments of the invention thus provide methods and apparatus for processing audio input signals, for example, so as to linearize the output of a given loudspeaker.

The skilled person will recognise that some aspects of the above-described apparatus and methods, for example the discovery and configuration methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Note that as used herein the term module shall be used to refer to a functional unit or block which may be implemented at least partly by dedicated hardware components such as custom defined circuitry and/or at least partly be implemented by one or more software processors or appropriate code running on a suitable general purpose processor or the like. A module may itself comprise other modules or functional units. A module may be provided by multiple components or sub-modules which need not be co-located and could be provided on different integrated circuits and/or running on different processors.

Embodiments may be implemented in an electronic device, especially a portable and/or battery powered electronic device such as a mobile telephone, an audio player, a video player, a PDA, a mobile computing platform such as a laptop computer or tablet and/or a games device for example.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope. Terms such as amplify or gain include possibly applying a scaling factor of less than unity to a signal.

The invention claimed is:

1. An audio processor, for modifying an audio signal to be provided to a loudspeaker, the audio processor comprising:

a first filter stage, for applying to an audio signal a linear model describing an excursion of the loudspeaker in response to a given input signal, the linear model containing only linear terms, and for generating one or more excursion signals;

a plurality of second filters for receiving the one or more excursion signals, each of the second filters configured to apply to a respective one of a plurality of frequency bands in the one or more excursion signals the inverse of a model describing an excursion of the loudspeaker in response to a given input signal;

a combiner for combining outputs of each of the plurality of second filters; and a limiter block configured to modify the one or more excursion signals so as to prevent the loudspeaker from exceeding an excursion limit, wherein at least a first one of the plurality of second filters applies the inverse of a non-linear model describing an excursion of the loudspeaker in response to a given input signal, the non-linear model comprising one or more non-linear parameters.

2. The audio processor as set out in claim 1, wherein the non-linear model further comprises one or more linear parameters.

3. The audio processor as set out in claim 2, wherein the non-linear model comprises the linear model and the one or more non-linear parameters.

4. The audio processor as set out in claim 1, wherein at least a second one of the plurality of second filters applies to its respective frequency band the inverse of the linear model.

5. The audio processor as set out in claim 1, wherein the limiter block is arranged between the first filter stage and the plurality of second filters.

6. The audio processor as set out in claim 1, further comprising:

an input for receiving an input audio signal; and a splitter configured to split the input audio signal into at least a high-frequency signal and a low-frequency signal, wherein the low-frequency signal is provided to the first filter stage as the audio signal.

7. The audio processor as set out in claim 6, wherein the combiner is further arranged to combine the outputs of the plurality of second filters with the high-frequency signal.

8. The audio processor as set out in claim 1, further comprising:

a module configured to receive a respective frequency band of an excursion signal of the one or more excursion signals, determine the one or more non-linear parameters based on the excursion signal, and provide the one or more non-linear parameters to at least the first one of the plurality of second filters.

9. The audio processor as set out in claim 1, wherein the linear model describes the excursion of the loudspeaker in response to a given input signal and a given amplification response.

10. The audio processor as set out in claim 1, wherein the non-linear model describes the excursion of the loudspeaker in response to a given input signal and a given amplification response.

11. The audio processor as set out in claim 1, wherein the one or more non-linear parameters comprise the force-factor of the loudspeaker.

12. The audio processor as set out in claim 1, wherein the one or more non-linear parameters comprise an effective stiffness of a suspension of the loudspeaker.

13. The audio processor as set out in claim 1, wherein the one or more non-linear parameters comprise Thiele-Small parameters.

14. The audio processor as set out in claim 1, wherein the linear terms comprise Thiele-Small parameters.

15. An electronic device comprising:

an audio processor for modifying an audio signal to be provided to a loudspeaker, the audio processor comprising:

a first filter stage, for applying to an audio signal a linear model describing an excursion of the loudspeaker in response to a given input signal, the linear model containing only linear terms, and for generating one or more excursion signals;

a plurality of second filters for receiving the one or more excursion signals, each of the second filters configured to apply to a respective one of a plurality of frequency bands in the one or more excursion signals the inverse of a model describing an excursion of the loudspeaker in response to a given input signal;

a combiner for combining outputs of each of the plurality of second filters; and a limiter block configured to modify the one or more excursion signals so as to prevent the loudspeaker from exceeding an excursion limit, wherein at least a first one of the plurality of second filters applies the inverse of a non-linear model describing an excursion of the loudspeaker in response to a given input signal, the non-linear model comprising one or more non-linear parameters.

16. The electronic device as set out in claim 15, wherein the electronic device is at least one of: a portable device; a battery powered device; a communications device; a computing device; a mobile telephone; a laptop, notebook or tablet computer; a personal media player; a gaming device; and a wearable device.

* * * * *